US011202536B1

(12) United States Patent
Reminga et al.

(10) Patent No.: US 11,202,536 B1
(45) Date of Patent: Dec. 21, 2021

(54) SYSTEM AND METHOD FOR CLOSING TOILET LIDS

(71) Applicant: Aon Invent, LLC, Bella Vista, AR (US)

(72) Inventors: Tom Reminga, St Petersburg, FL (US); Larry Robertson, Bella Vista, AR (US); Andrew Bojie, Bentonville, AR (US)

(73) Assignee: Aon Invent LLC, Bella Vista, AR (US)

( * ) Notice: Subject to any disclaimer, the term of this patent is extended or adjusted under 35 U.S.C. 154(b) by 45 days.

(21) Appl. No.: 16/889,436

(22) Filed: Jun. 1, 2020

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1–246.5
See application file for complete search history.

(56) References Cited

U.S. PATENT DOCUMENTS

| | | | | |
|---|---|---|---|---|
| 5,289,593 A * | 3/1994 | Lawrence | ..... | A47K 13/10 4/246.1 |
| 5,754,985 A * | 5/1998 | Dias | ..... | A47K 13/10 4/241 |
| 6,438,764 B1 | 8/2002 | Andersen | | |
| 9,438,764 B2 * | 9/2016 | Kusakabe | ..... | H04N 1/00413 |

* cited by examiner

*Primary Examiner* — Christine J Skubinna
(74) *Attorney, Agent, or Firm* — Chris Tanner; FYPA PLLC

(57) ABSTRACT

A toilet closure system and a method of installing the same are provided. The closure system is adapted to mount to a typical conventional toilet having a conventional seat and lid, a conventional tank, and a conventional flush mechanism. The toilet closure system ensures that the seat and lid of a toilet is always closed, and is never left open for any reason, except during use. Further, the installation process can be achieved with a minimum of tools, and does not require specialized mechanical knowledge or plumbing knowledge.

18 Claims, 16 Drawing Sheets

SYSTEM AND METHOD FOR CLOSING TOILET LIDS

BACKGROUND

Users often neglect to fully close a toilet lid after use, a device for automatically closing a lid upon conventional flushing of the toilet offers a number of advantages. For example, when not in use, a fully closed toilet is safer in that it prevents children and pets from falling into the toilet bowl. In addition, a closed toilet is more sanitary in that it prevents pets from drinking from the bowl and averts cases of toilet users leaving the seat and lid assembly in an open position.

It is also advantageous eliminate a situation where a male user utilizes a toilet without raising the seat prior to urinating. The embodiments herein require that a male bend over and raise at least the lid, and preferably both the lid and seat, prior to urinating. Moreover, a fully closed toilet is overall more aesthetically pleasing.

Consequently, a mechanism for automatically closing a toilet seat/lid is desired.

SUMMARY OF THE INVENTION

A toilet closure system and a method of installing the same are described herein. The closure system is adapted to mount to a typical conventional toilet having a conventional seat and lid, a conventional tank, and a conventional flush mechanism. The toilet closure system ensures that the seat and lid of a toilet is always closed, and is never left open for any reason, except during use. This status of being permanently closed is advantageous for numerous reasons, including but not limited to preventing children and pets from falling into the toilet bowl. In addition, a closed toilet is more sanitary in that it prevents pets from drinking from the bowl.

Also, as stated, a fully closed toilet is overall more aesthetically pleasing. Further, the installation process for the system described herein can be achieved with a minimum of tools, and does not require specialized mechanical knowledge or plumbing knowledge.

The apparatus includes three sub-assemblies, a plunger sub-assembly, a trigger sub-assembly, and a float sub-assembly. These three sub-assemblies work together to ensure that the toilet seat/lid remains closed except when in-use.

DETAILED DESCRIPTION OF THE PREFERRED EMBODIMENTS

This disclosure describes the embodiments herein in a context of assembly, installation, and use. Sometimes the expression "installer" may appear, and other times "user". These roles may be different, but they can also overlap.

Overview and Explanation of Components of the System 100

Figure 1:
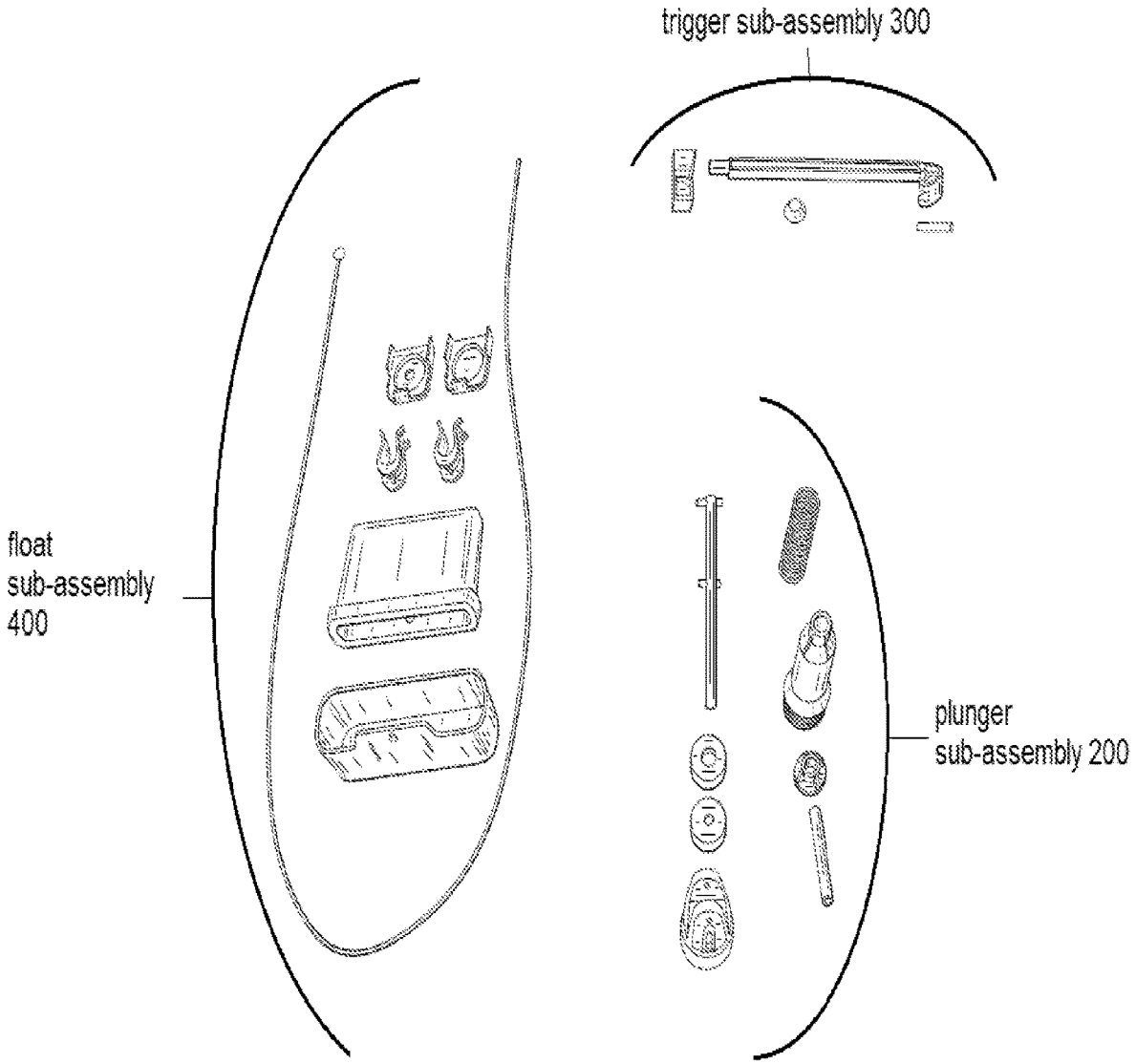
FIG. 1 shows the components of a system for achieving toilet closure.

FIG. 1 shows the components of a system 100 for achieving toilet closure, where the components are sectioned into three sub-assemblies: a plunger sub-assembly 200, a trigger sub-assembly 300, and a float sub-assembly 400.

Figure 2:
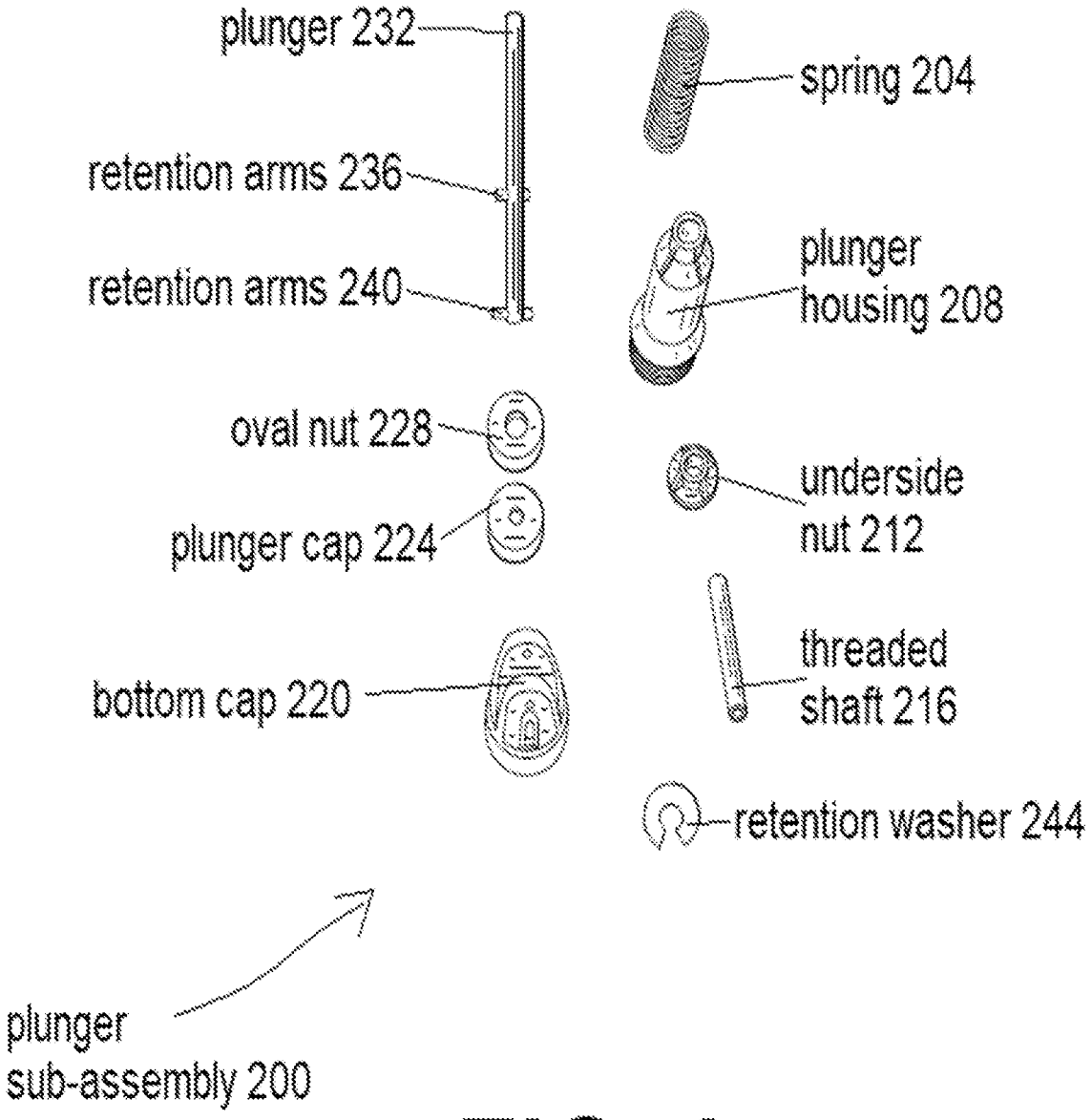
FIG. 2 shows a first sub-assembly within the system of FIG. 1.

As shown in FIG. 2, the plunger sub-assembly 200 comprises a spring 204, a plunger housing 208, an underside nut 212, a threaded shaft 216, a bottom cap 220, a plunger cap 224, an oval nut 228, and a plunger 232. In an embodiment, the underside nut 212 can be formed from Acrylonitrile Butadiene Styrene (ABS).

The threaded oval nut 228 fits into the existing toilet seat, and is threaded to accept the threaded shaft 216. During use, the plunger cap 224 is located at the top or highest vertical point of the entire plunger sub-assembly 200.

The threaded underside nut 212 goes underneath the seat-attachment hinge structure of the toilet body 516. The threads of a lower end of the threaded shaft 216 mate with the threaded underside nut 212, for attaching to the toilet body 516 (e.g. Prior Art FIGS. 5A and 6). Meanwhile, the threaded oval nut 228 matches with an upper end of the threaded shaft 216. The steel threaded shaft 216 goes into the plunger housing 208.

Figure 7:
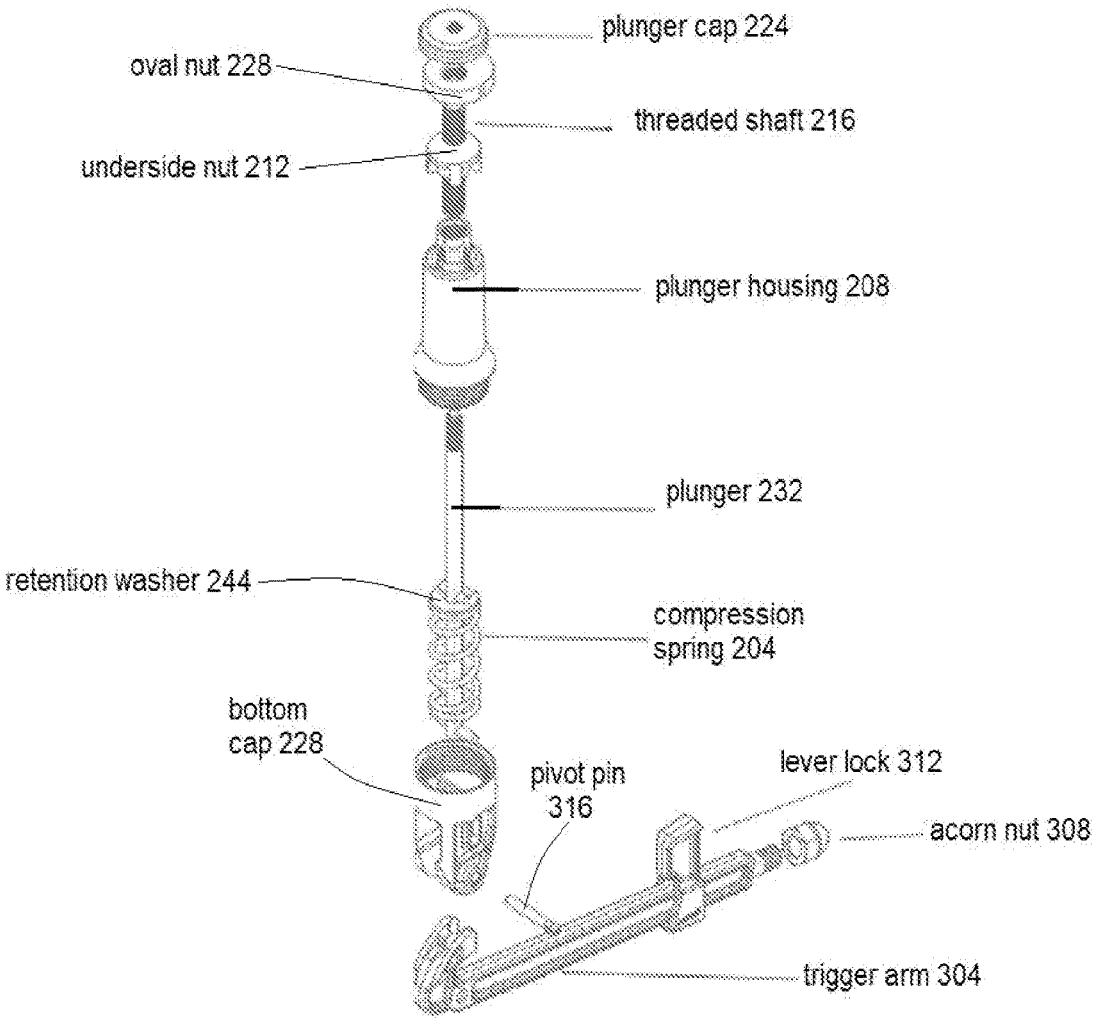
FIG. 7 shows detail of both the plunger sub-assembly and the trigger sub-assembly 300, and how to connect the two.

As can be seen at least from FIGS. 2 and 7, the underside nut 212 is threaded and also has finger-adjustable flanges, for the purpose of hand-tightening. Within FIGS. 8 and 9, the underside nut 212 is in-use but is obscured from view. Accordingly, securing the plunger sub-assembly 200 to the toilet body 516 is achieved using the underside nut 212. In this case, the entire system 100 is installable and operable using fingers-only so that no extra tools are needed.

From FIG. 2 it is apparent the plunger 232 has two sets of perpendicular arms 236 (the shorter set, towards the middle of the plunger) and 240 (the longer set, at one end of the plunger). During assembly, the spring 204 is slid over the shorter set 236, the spring 204 having a wider diameter than the arms 236. Once the spring 204 is slid into place, one end of the spring 204 permanently urges against the longer arms 240, which extend wider than the spring 204. The retention washer 236 acts to hold the spring 204 in place and also cause the spring 204 to be continually urging against the longer set 240 of the perpendicular arms.

The plunger housing 208 contains the spring 204 which continually urges the plunger shaft 232 upwards to initiate closure. The plunger shaft 232 comprises an external threaded top section to hold the internally threaded plunger cap 224. The threaded section of the plunger shaft 232 is significantly longer than the threaded porting of the plunger cap 224 in order to allow fine adjustment to the mechanism and actuation of the plunger cap 224. In an embodiment, the plunger cap 224 and plunger shaft 232 use a friction thread to prevent the plunger cap 224 from creeping away from the desired position. In an embodiment, the plunger cap 224 can be formed from mild steel, and be nickel plated.

Figure 3:
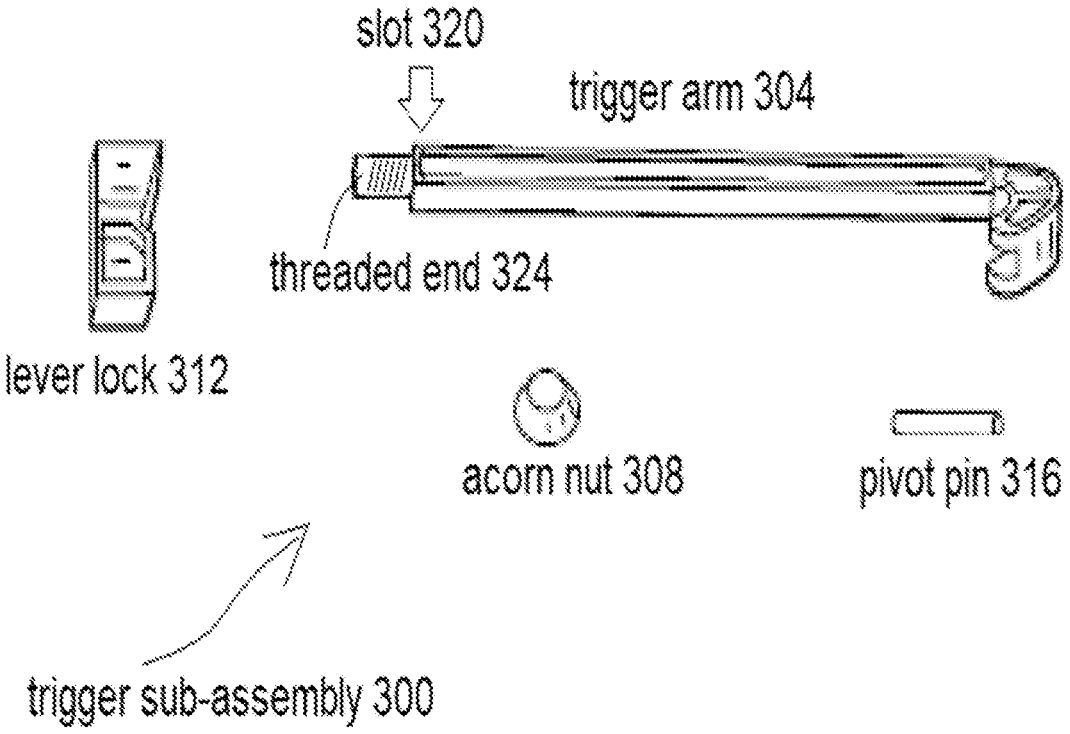
FIG. 3 shows a second sub-assembly within the system of FIG. 1.

As shown at least within FIG. 3, the trigger sub-assembly 300 comprises a trigger arm 304, an acorn nut 308, and level lock 312. In an embodiment, the trigger arm 304 can be formed from ABS. From FIG. 3 it is also apparent that an opposite end of the trigger arm 304 is threaded 324 and also has a slot 320 to accommodate the float ribbon cord. During use, the level lock 312 is secured using an acorn nut 308 located at one end of the trigger arm 304. A pivot pin 316 goes with the sub assembly 300. This is where the vast majority of the motion aspects of the system 100 occur. This motion action releases or retains the entire system 100.

Figure 4A:
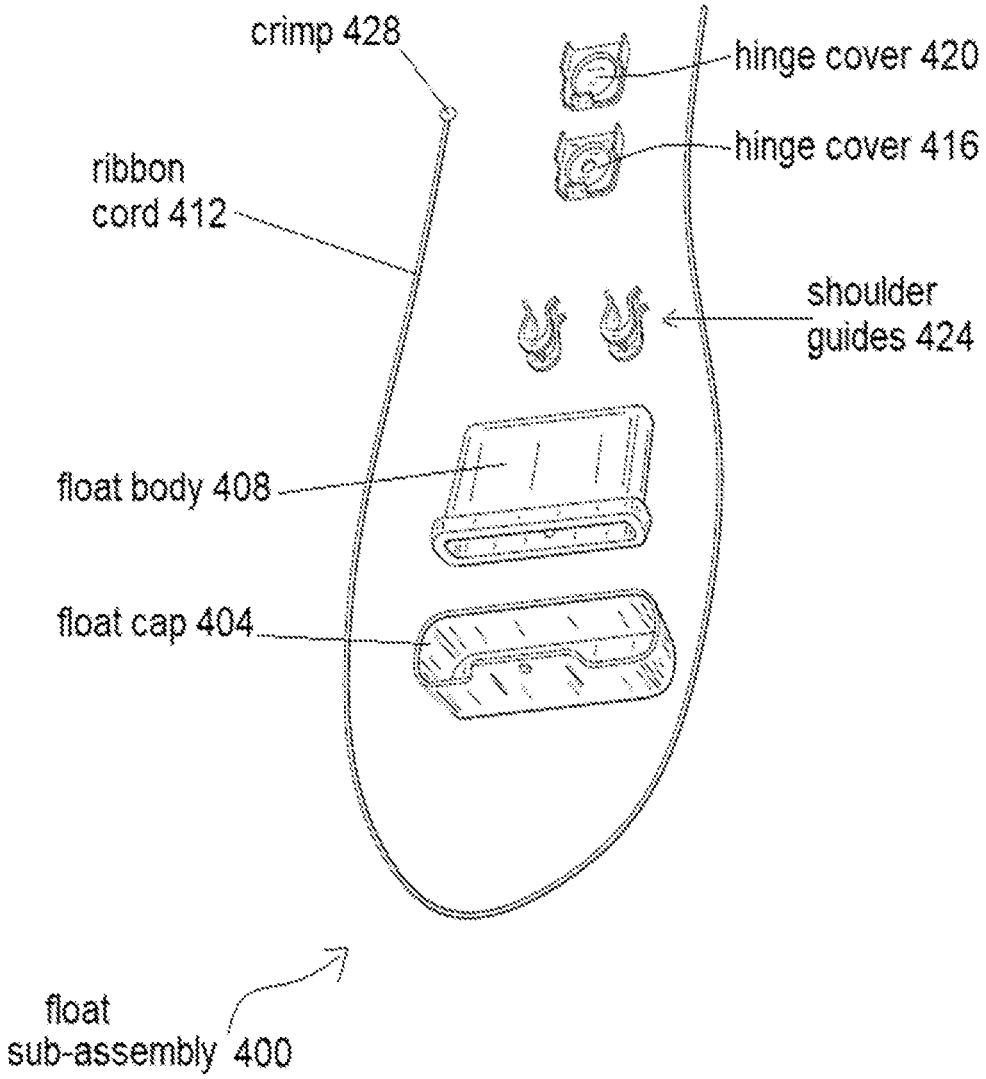
FIGS. 4A and 4B show a third sub-assembly within the system of FIG. 1.

As shown in FIG. 4, the float sub-assembly 400 comprises a float cap 404, a float body 408, a ribbon cord 412, a pair of hinge covers 416 and 420, and a pair of shoulder guides 424. The shoulder guides 424 are located on a back of the toilet tank. The hinge covers 416 and 420 go over the hinge mounts 524 of the toilet body 516.

Installation of the System 100

With the various parts now disclosed, it is now possible to start installing the system 100 on a toilet body 516. There are a variety of order of operations for building and installing the system 100, but it will be assumed that by the time a user is ready to install, all three sub-assemblies 200, 300, and 400 are all snapped together and in-place.

Figure 5A:
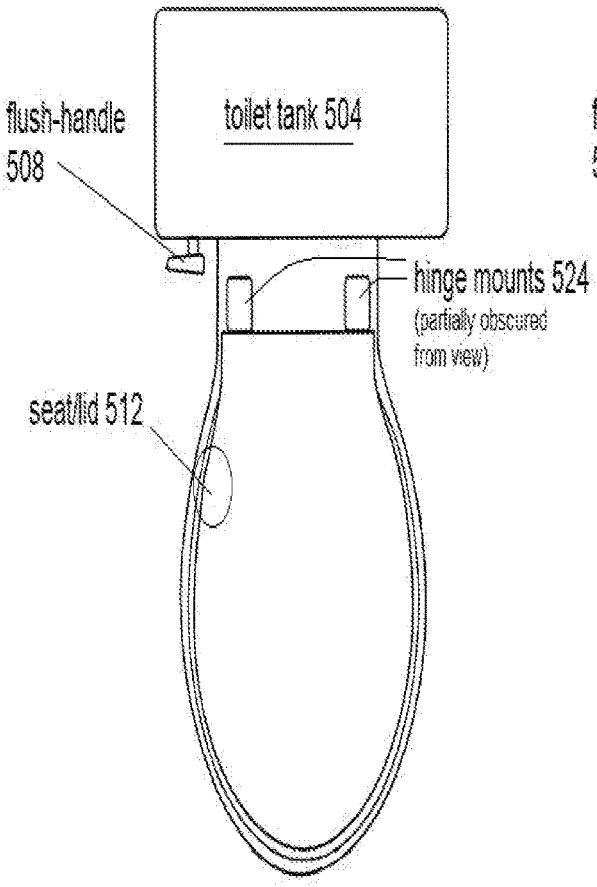
FIG. 5A (Prior Art)
FIG. 5A shows a prior art toilet fixture.
Figure 6:
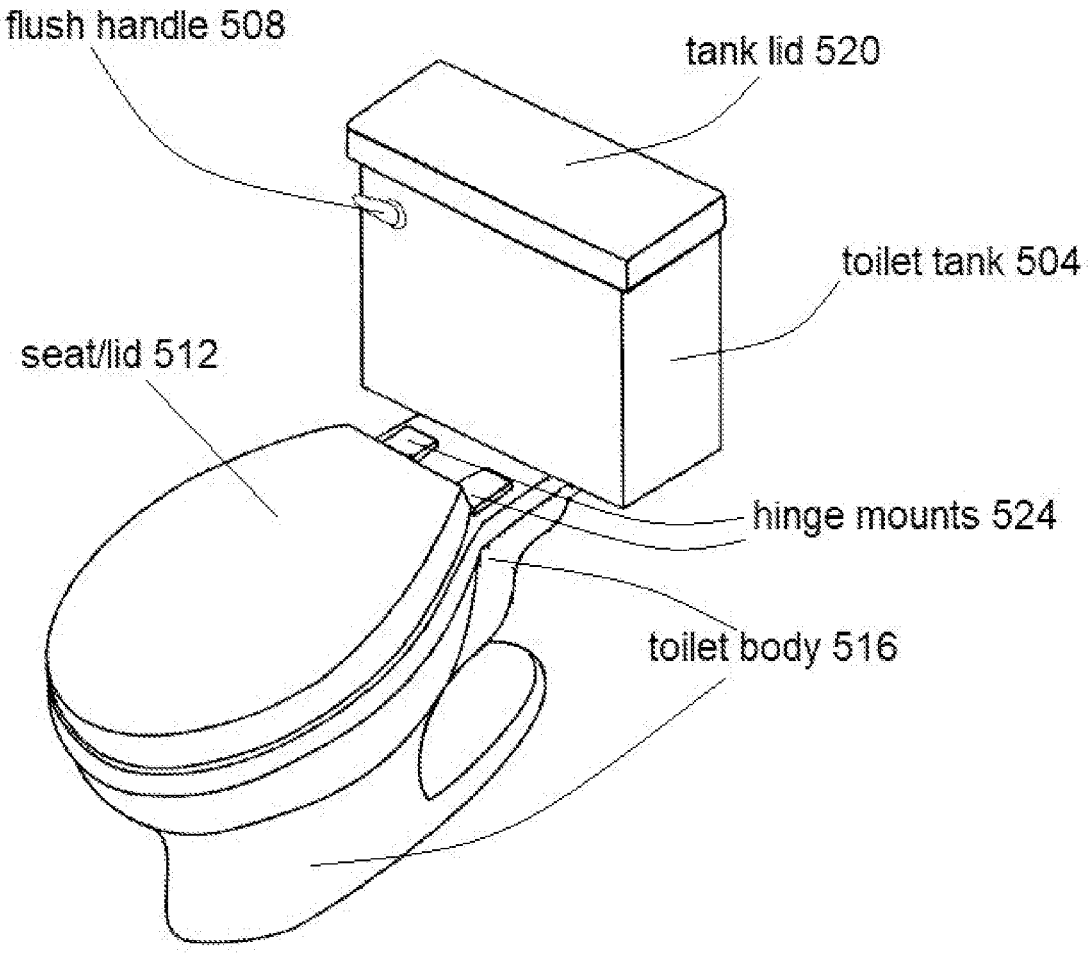
FIG. 6 (Prior Art)
FIG. 6 shows a second view of the prior art toilet fixture of FIG. 5A.

FIGS. 5A6 (Prior Art) show a conventional toilet comprising a toilet tank 504, a flush handle 508, a seat/lid 512, a toilet body 516, a tank lid 520, and a pair of hinge mounts 524. As is well-known in the art, the seat/lid 512 pivots at the hinge mounts 524. The combination of seat/lid 512 can of course operate separately, as is well-known in the art, but within this disclosure will be referred together as seat/lid 512. Within this disclosure, for brevity, avoiding distraction, and explaining the embodiments herein, it will be assumed that the seat/lid 512 generally move together, in unison. Of course they are separable, but within this disclosure, for the purposes of explanation, the seat/lid 512 will be considered to move together.

Installing the system 100 will start with the sub-assembly 200, and then linking the sub-assembly 300 thereto. After this, the sub-assembly 400 will be put into place, thus completing the installation process.

In an embodiment, installation of the system 100 begins by removing the existing lid or in the case of a new toilet, by installing a mounting bolt opposite of the system 100. In the event of a toilet already equipped with a compatible lid-seat, one way to begin installing the sub-assembly 200 is to start by taking apart the hinge-mounts 524, and substituting the oval nut 228 inside of one of the two hinge-mounts 524.

Figure 8:
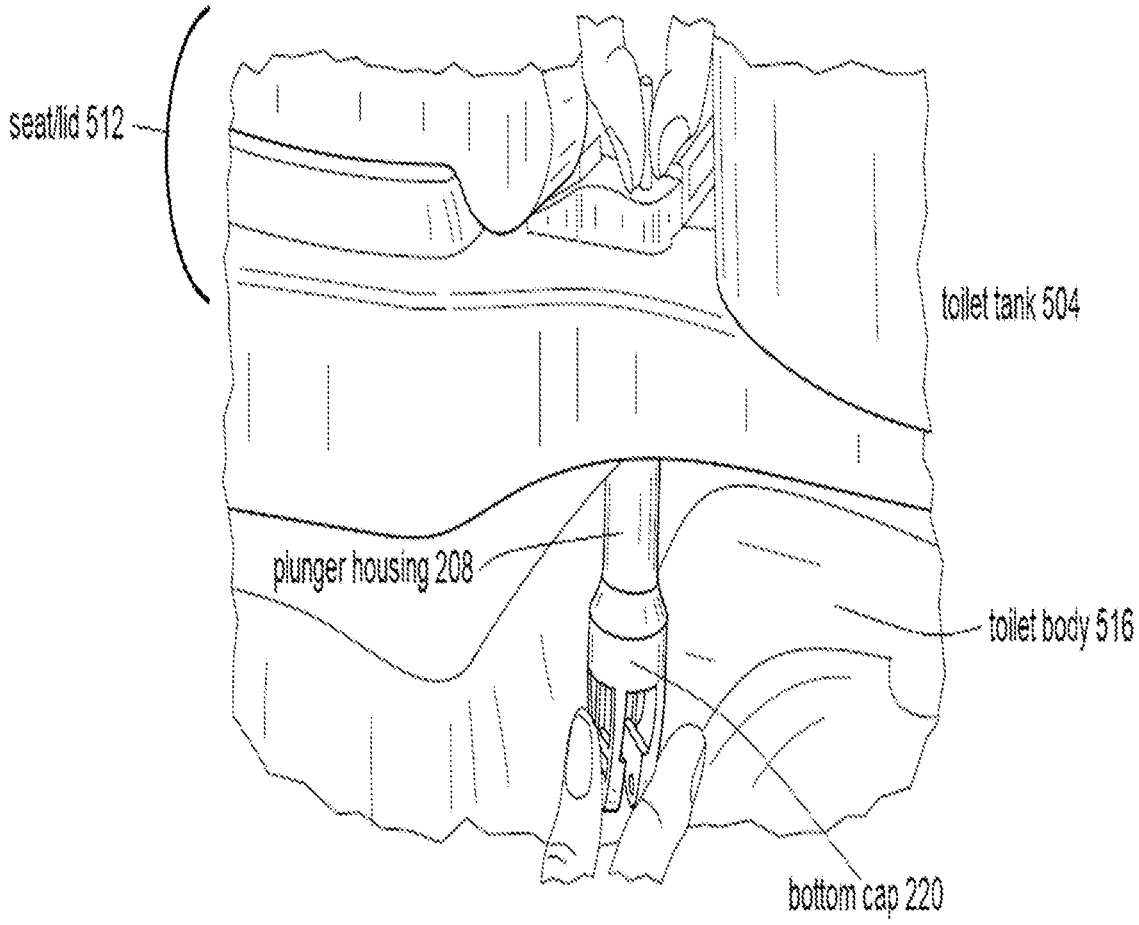
FIG. 8 shows how the completed plunger sub-assembly screws in until one can start to see the metal of the threaded shaft protruding through matching threads within the oval nut.

As shown in FIG. 8, once the oval nut 228 is properly substituted within one of the hinge mounts 524, the completed plunger sub-assembly 200 screws in until one can start to see the metal of the threaded shaft 216 (attached to the plunger housing 208) protruding through matching threads within the oval nut 228. Everything shown in FIG. 8 occurs without any tools of any kind, and can all be done manually with just fingers. It is only necessary to keep twisting the assembly 200 until the metal of the threaded shaft 216 is slightly visible. Twisting too far could strip the matching threads within the oval nut 228 but also could prevent the mechanism from engaging when the lid is raised.

Figure 9:
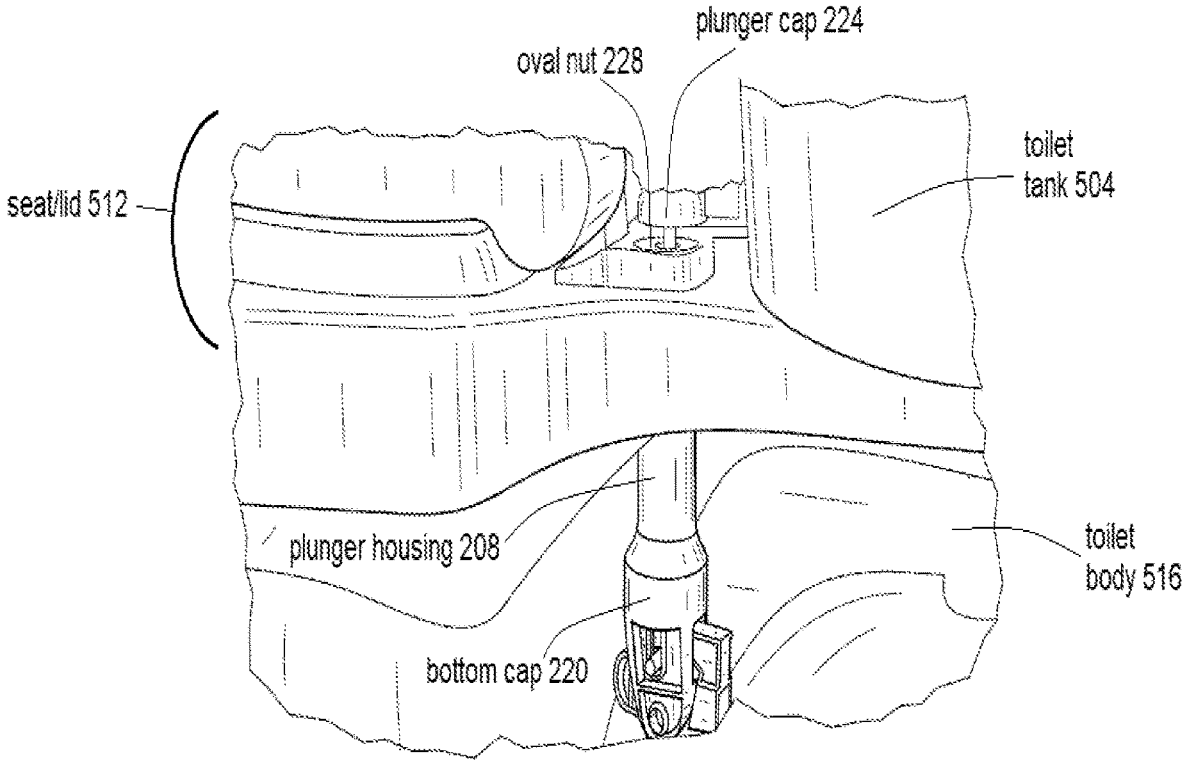
FIG. 9 shows how an installer can screw the plunger cap onto the plunger.
Figure 10:
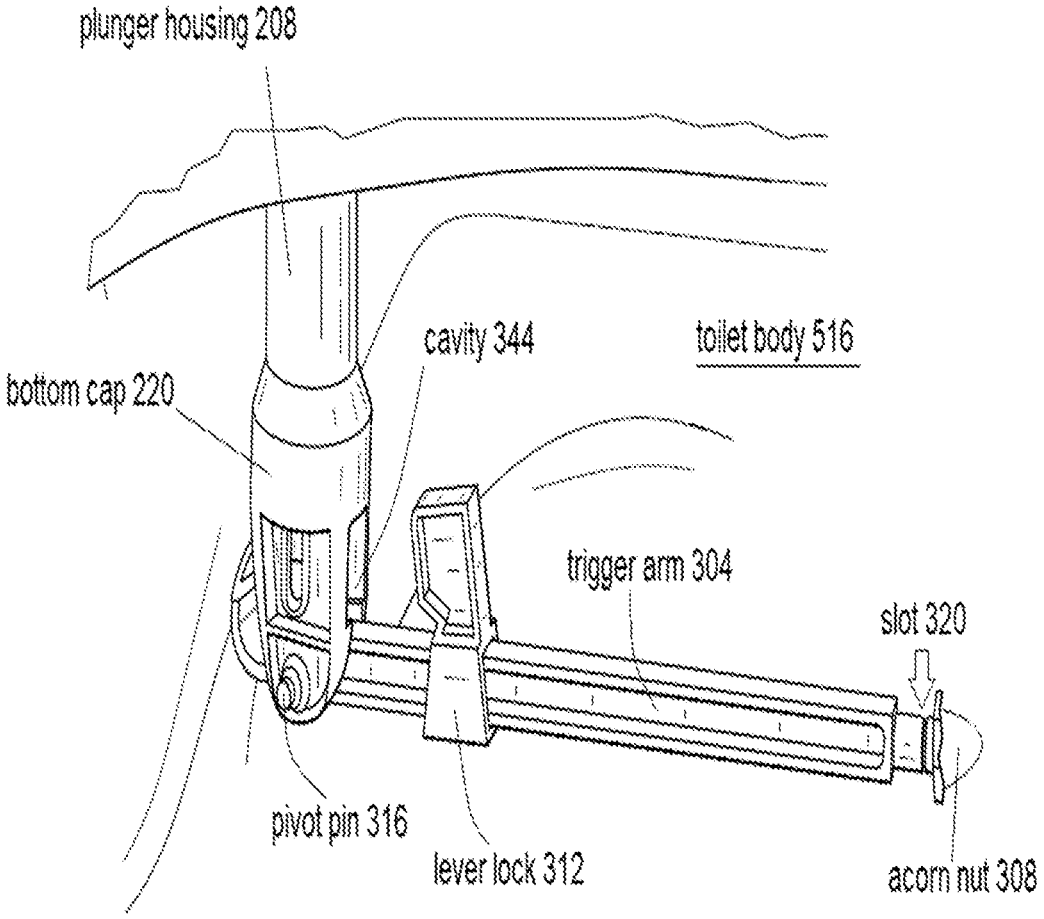
FIG. 10 shows the trigger arm being positioned near to the plunger housing cap and then aligned for insertion of the retaining pin or pivot pin.

Once the threaded shaft 216 is visible at the top of the oval nut, the installer can screw the plunger cap 224 onto the plunger 232, as shown in FIG. 9. Then, as shown in FIG. 10, the trigger arm 304 is positioned in the plunger housing cap 220 and aligned for insertion of the retaining pin or pivot pin 316.

Figure 4B:
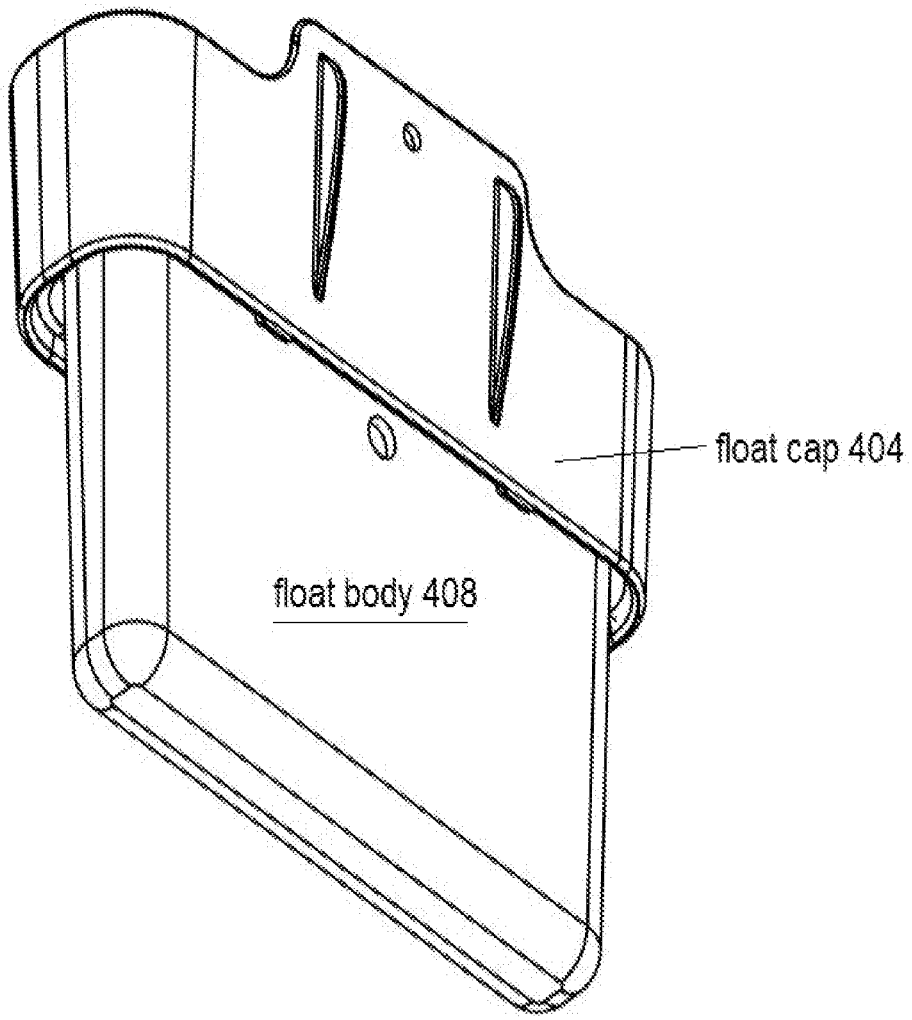
Figure 11A:
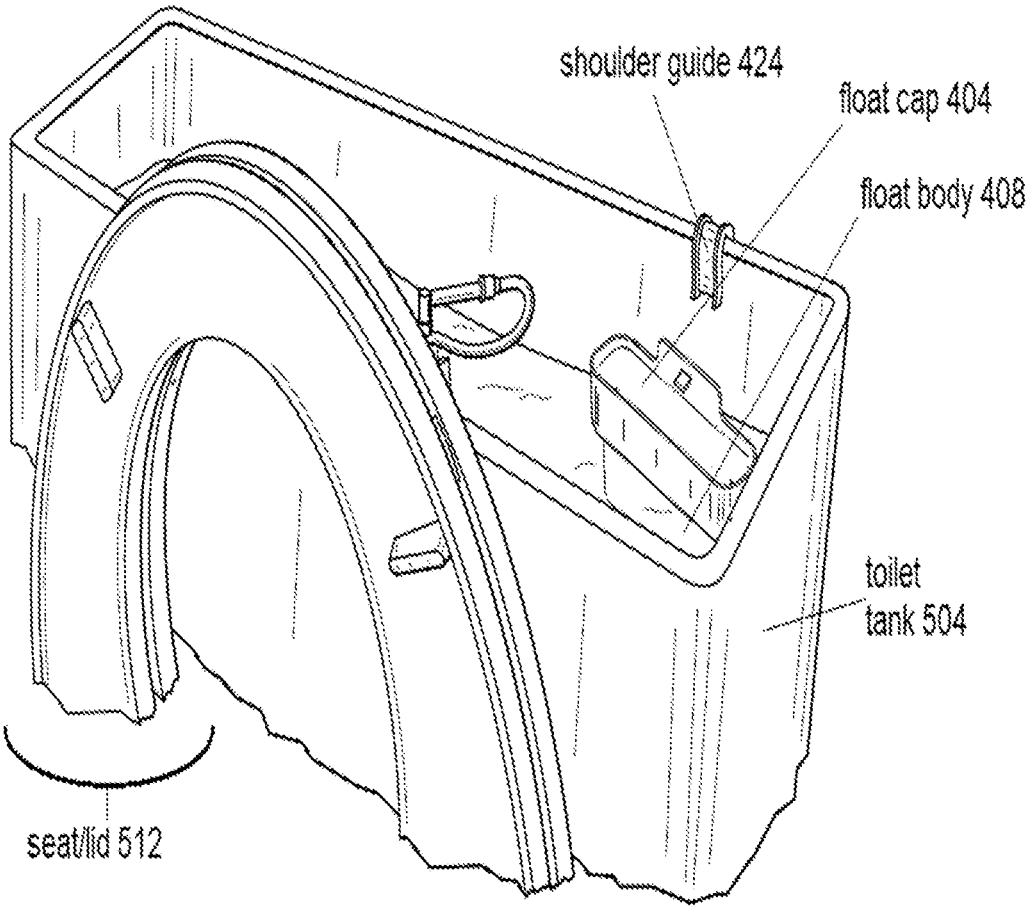
FIG. 11A shows shoulder guides being clipped over the back of the toilet tank to prevent the tank lid from restricting movement of the ribbon cords.
Figure 11B:
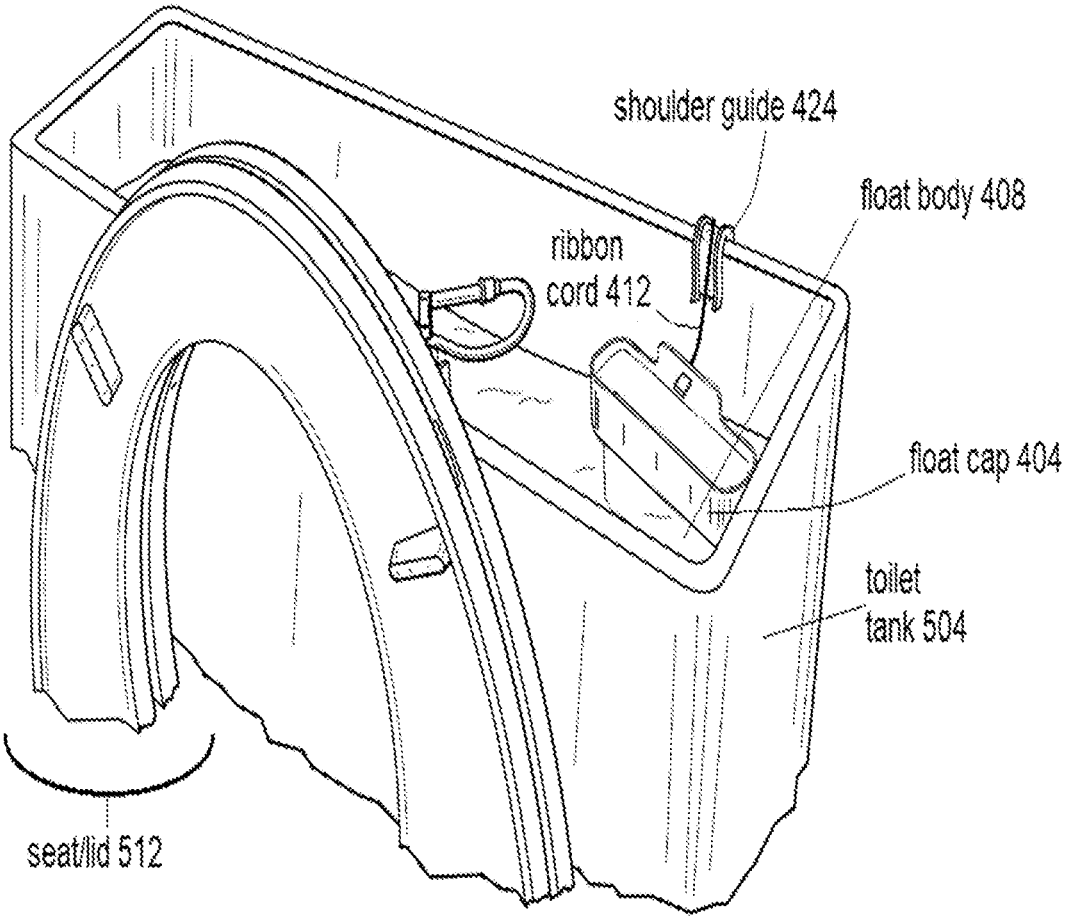
FIG. 11B shows routing of the ribbon cord through a shoulder guide.

The float cap 404 and the float body 408 snap together to form a type of hollow box (see at least FIGS. 4B, 11A, and 11B). The float body 408 has two holes therein, suitable for admitting water. During use, the float body 408 will fill with water. As such, the float body 408 acts like a keel on a boat. The tether or ribbon cord 412 is routed through a hole in the float cap 404, and is crimped at the end to remain within and be securely responsive to a position of the float sub-assembly 400. Thus, as the float assembly 400 moves upward or downward, the tension on the ribbon cord 412 will change proportionally. The crimp 428 is attached to the tether or ribbon cord 412. In an embodiment, the crimp 428 can be formed from aluminum. The tether or ribbon cord 412 thus stays secured to the float assembly 410.

In an embodiment, the crimp 428 can be attached to the ribbon cord 412 using tools such as pliers. However, the crimp 428 can also be configured to be hand-attached to the ribbon cord 412 where no tools are required.

The float assembly 400 is integral to the operation and efficiency of the system 100. The shape of the weighted float sub-assembly 400 is chosen for a variety of reasons, but one is to maximize shipping efficiency by utilizing water from the toilet tank 504 to provide weight necessary to raise the trigger arm 304 adequately to release the plunger 232 when the toilet is flushed. The shape is also designed to allow easy set up and placement around the mechanical components already present in a typical toilet tank 504. In an embodiment, the box-shaped portion of the float sub-assembly 400 is of two-piece construction, specifically float cap 404 and float body 408. However, this is for convenient explanation and example only, so that the embodiments herein should not be considered as limited exclusively thereto.

Once installed, the lower section 408 of the float sub-assembly 400 fills with water through the two or more holes or vents towards the upper half of a flat side. The water acts as a weight and a keel. Meanwhile, the top section flat cap 404 snaps into place securely and has a hollow watertight top section that acts as a float. Finally, a hole exists in the top cap 404 to connect to the ribbon cord 412. In an embodiment, the ribbon cord 412 can be formed from a nylon base.

As shown in FIG. 11A, the shoulder guides 424 clip over the back of the toilet tank 504 to prevent the tank lid 520 from restricting movement of the ribbon cords 412, either during a flush or also while the toilet tank 504 is refilling. Additional embodiments of the shoulder guides 424 include having a smooth low-friction surface to promote free movement of the float sub-assembly 400. The shoulder guides 424 also have raised geometry that lifts the tank lid on the toilet slightly to prevent pinching of the material comprising the ribbon cord 412, thereby allowing the system 100 to function more efficiently.

As shown in FIG. 11B, during installation, an installer will thread the ribbon cord 412 through the shoulder guide 424 and that float sub-assembly 400 is now almost full of water. Then, the installer will thread the tether or ribbon cord 412 through the trigger arm 304 at the slot 320 shown in FIG. 3 and secure the ribbon cord 412 using the acorn nut 308.

This combination allows the tether or ribbon cord 412 to be adjustably secured into place. This acorn nut 308 offers easy adjustability so that the float can be adjusted to various models of commodes.

Once the sub-assembly 200 and 300 are moving toward completing installation, a final step will be adding the plunger cap 224. An installer can snap or thread the plunger cap 224 into place on top of the plunger 232.

As shown in FIG. 7, in joining the plunger sub-assembly 200 to the trigger sub-assembly 300, it is necessary to first align the two sub-assemblies, and then insert the pivot pin 316.

Figure 5B:
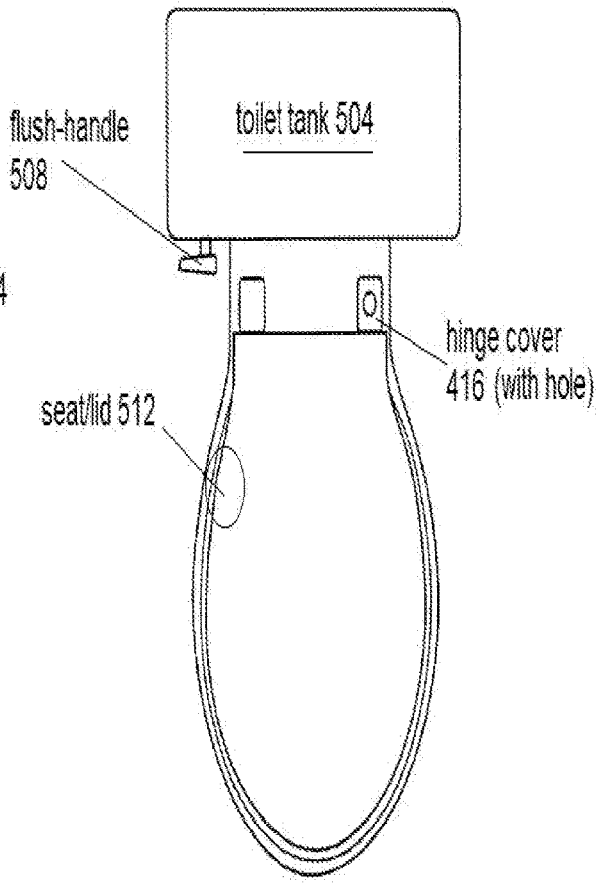
FIG. 5B shows the toilet fixture of FIG. 5A at the beginning stages of installation the system of FIG. 1.

FIGS. 5A\6 (Prior Art) show two separate hinge mounts 524 as is typical within a conventional toilet body 516. Meanwhile, FIG. 5B shows that one hinge mount 524 will have a hinge cover 416 having a plunger hole. Meanwhile, the other hinged mount 524 will have a plain hinge cover 420.

Figure 12:
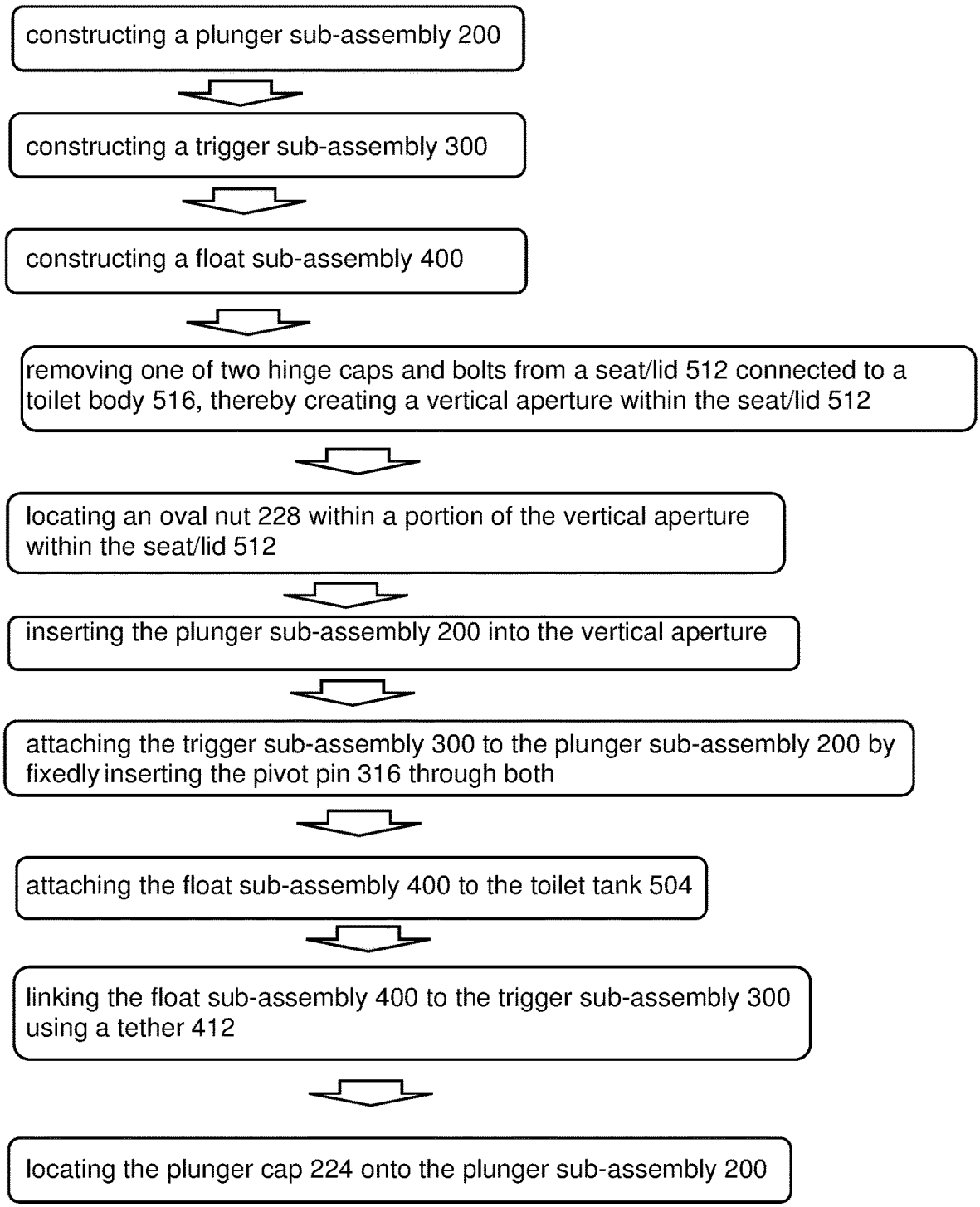
FIG. 12 shows an example, non-limiting method for installing the system.
Figure 13:
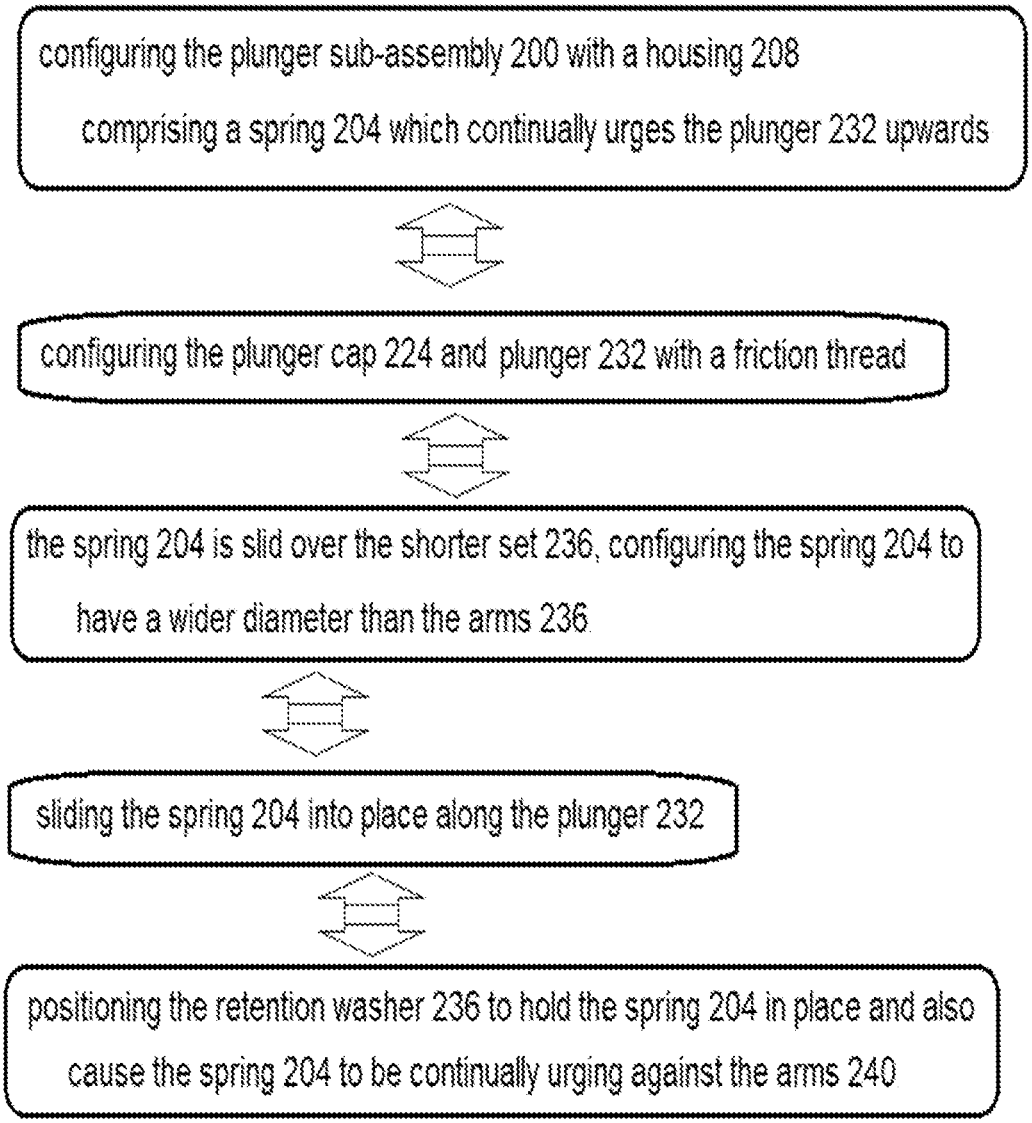
FIG. 13 shows some example, non-limiting additional steps relating to the plunger sub-assembly.
Figure 14:
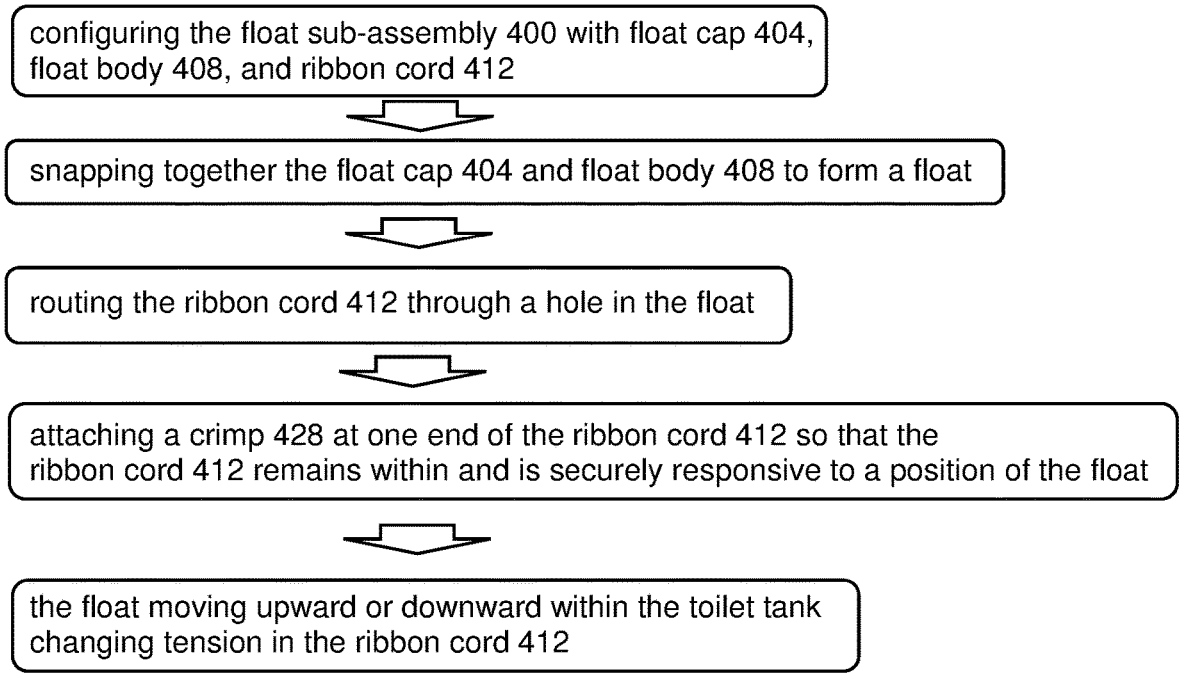
FIG. 14 shows some example, non-limiting additional steps relating to the float sub-assembly.

An example, non-limiting method for installing the system 100 is shown in FIG. 12. FIG. 13 shows some example, non-limiting additional steps relating to the plunger sub-assembly 200. The arrows in FIG. 13 go in both directions, to symbolize that the various method steps in FIG. 13 could be performed in a variety of orders, and that the order shown in FIG. 13 should not be considered limiting. FIG. 14 shows some example, non-limiting additional steps relating to the float sub-assembly 400.

Adjusting and Re-Positioning the System 100

During use, it is important that the seat\lid 512 not be advanced too far forward, or too far rearward. Instead, during the time the seat\lid 512 is in its open position, it should be as close as possible to a near-vertical position. To achieve this, the system 100 has an adjustment mechanism. A user can spin the plunger cap 224 upward or downward, and adjust to achieve the desired near-vertical position. That is, if the seat\lid 512 is a bit too far forward from vertical, a user can spin the plunger cap 224 to go downward a bit. Similarly, if the seat\lid 512 is a bit too far rearward from vertical, a user can spin the plunger cap 224 to go upward a bit.

It is important to take out all the play or slackness present on the tether or ribbon cord 412. To achieve this, hold the trigger arm 304 in its locked position, and also ensure that the float assembly 410 is at its highest vertical position. Put the trigger arm 304 into its lower position and when the float assembly is floating (meaning up, its highest vertical position), that will be a position best suitable to achieve snug tautness of the ribbon cord 412. Then, pull on the ribbon cord 412 until tautness is achieved, and then hand-tighten the acorn nut 308 at the rear end of the trigger arm, until the ribbon cord 412 is secure within the trigger arm 304.

Actual Operation of the System 100

When the plunger cap 224 is in its downward, lowered position (ready to spring, under spring-tension), the toilet seat is in its open position. At such time as the plunger cap 224 is in its upward, raised position (sprung, no spring-tension), the toilet seat moves and eventually arrives at its closed position.

A user wanting to use the toilet will lift the lid and or seat (while males and females will go about this differently, e.g. perhaps operating only the lid but not the seat, for simplicity this will be referred to as the seat\lid 512). This act of lifting will apply downward pressure to the plunger cap 224, putting the plunger housing 208 back into its spring-tension position.

Moving to after use, e.g. when a flush occurs, that is, when the user is finished and presses the flush handle 508 and the toilet tank starts emptying, the fully-weighted float sub-assembly 400 will descend downward as the water level in the toilet tank 504 descends downward. This in turn will increase tension in the ribbon cord 412, which in turn will cause a pulling on the trigger arm 304. This pulling action will eventually cause the plunger cap 224 to snap upwards due to release of the spring 204 within the plunger housing 208. The act of the plunger cap 224 snapping upwards causes the seat/lid 512 to rotate their hinge-mounts 524, eventually settling into a closed position.

Meanwhile, post-flush, fresh water is moving into the toilet tank 504 so that as this occurs, the float sub-assembly 400 is rising upwards, in proportion with the level of the toilet tank as it fills back up. This re-filling will eventually bring the float sub-assembly 400 upwards to its normal resting point at the top of the tank. This in turn reduces tension on the ribbon cord 412.

When another user arrives, and starts another usage cycle by lifting the seat/lid 512, this action puts downward pressure on the plunger cap 224 and "arms" the system 100, that is, puts the system 100 under full spring pressure within the plunger housing 208. This in turn means the trigger arm 304 is triggered, and the system 100 is ready to automatically lower the seat/lid 512 as soon as the user hits the flush handle 508.

The compressive force necessary to store the potential energy in the spring 204 comes from the user who lifts the seat/lid 516. A user may notice a slight increase in resistance while lifting the seat/lid 516, but such increase is expected to be negligible. As such, the energy necessary to operate and engage the system 100 is provided solely by a user and is stored entirely in the spring 204, such that no external power source is required for the system 100.

Disabling the System 100

There are times when it is going to be undesirable for the embodiments herein to be engaged and functional. This can include, but is not limited to, multiple people need to use the bathroom, rinsing of diapers, and other situations. That is, there are lots of different applications when it is desirable to have the system 100 disengaged.

Accordingly, there exists a sliding level lock 312 to disengage the system 100. The sliding level lock 312 can be manually slid by a user into a cavity 344 within the trigger arm 304. In this state, the trigger arm 304 is prevented from being engaged. To re-engage the system 100, it is only necessary to move the lever lock 312 away from the cavity 344 and more towards the center of the trigger arm 304. At that time, the system 100 returns to working as normal.

The sliding lever lock 312 allows the user to temporarily deactivate the automatic close feature for various purposes, such as when cleaning the toilet bowl, rinsing out dirty diapers or anytime multiple flushes may be desired without closing the lid and or seat. The sliding lever lock 312 slides along the trigger arm 304 to the forwardmost position under the spring housing to prevent the spring mechanism from releasing and pushing the plunger into the lid and thereafter close when the toilet system is flushed.

What is claimed is:

1. A method of installing and configuring a toilet system, comprising:

constructing a plunger sub-assembly;

constructing a trigger sub-assembly;

constructing a float sub-assembly;

removing one of two hinge caps and bolts from a seat/lid connected to a toilet body, thereby creating a vertical aperture;

locating an oval nut within a portion of the vertical aperture within the seat/lid;

inserting the plunger sub-assembly into the vertical aperture;

attaching the trigger sub-assembly to the plunger sub-assembly by fixedly inserting the retaining pin or pivot pin through both;

attaching the float sub-assembly to the toilet tank;

linking the float sub-assembly to the trigger sub-assembly using a tether; and locating the plunger cap onto the plunger sub-assembly.

2. The method of claim 1, further comprising:

threading the plunger sub-assembly through the oval nut; and rotatably threading the plunger sub-assembly upward until a metal portion of a threaded shaft can be seen above the oval nut.

3. The method of claim 1, further comprising:

configuring the plunger sub-assembly with a housing comprising a spring and plunger shaft, the spring continually urging a plunger shaft upwards to initiate closure of the toilet seat/lid through the plunger cap.

4. The method of claim 3, further comprising:

configuring the plunger cap and the plunger shaft with a friction thread to prevent the plunger cap from creeping away from a desired position.

5. The method of claim 1, further comprising:

configuring the float sub-assembly with a float cap, a float body, and a ribbon cord; and snapping together the float cap and the float body to form a float mechanism.

6. The method of claim 5, further comprising:

routing the ribbon cord through a hole in the float assembly; and attaching a crimp at one end of the ribbon cord so that the ribbon cord remains within and is securely responsive to a position of the float mechanism so that the float mechanism moving upward or downward within the toilet tank changes a tension on the ribbon cord.

7. The method of claim 5, further comprising:

snapping a flat cap into place securely and has a hollow watertight top section that acts as a float;

routing the ribbon cord through a hole in the flat cap.

8. The method of claim 5, further comprising:

clipping a pair of shoulder guides over the back of the toilet tank thereby preventing a tank lid from restricting movement of the ribbon cords either during a flush or while the toilet tank is refilling.

9. The method of claim 8, further comprising:

configuring the shoulder guides to have smooth low-friction surfaces to promote free movement of the float sub-assembly; and configuring the shoulder guides clip to have raised geometry that lifts the tank lid on the toilet slightly to prevent pinching of the material comprising the ribbon cord.

10. The method of claim 8, further comprising:

threading the ribbon cord through one of the shoulder guides; and thread the ribbon cord through the trigger arm at a slot located therein.

11. The method of claim 10, further comprising:

tightening the acorn nut thereby securing the ribbon cord into place at a specific predetermined tension.

12. The method of claim 1, further comprising:

in a configuration where the seat/lid is fastened to the toilet body at two separate hinged locations with two separate hinge covers, at one location substituting a first hinge cover having a plunger hole; and at the other location substituting a second hinge cover which does not have any hole.

13. The method of claim 1, further comprising:

adjusting a verticality of the seat/lid by rotating the plunger cap upward or downward and visually calibrating thereby achieving a desired near-vertical position.

14. The method of claim 11, further comprising:

setting and adjusting a desired tension on the ribbon cord by holding the trigger arm in a locked position, and simultaneously ensuring that the float mechanism is at its highest vertical position;

pulling on the ribbon cord until tautness is achieved; and hand-tightening the acorn nut at the rear end of the trigger arm until the ribbon cord is secure, fixed, and non-moving within the trigger arm.

15. The method of claim 1, further comprising:

disabling the toilet system by the sliding level lock into a cavity within the trigger arm.

16. The method of claim 1, further comprising:

re-engaging the toilet system by moving the lever lock away from a/the cavity within the trigger arm and more towards the center of the trigger arm.

17. The method of claim 1, further comprising:

the energy necessary to operate and engage the toilet system being provided by a user and being stored entirely in the spring, such that no external power source is required for the system.

18. The method of claim 1, further comprising:

configuring the underside nut to be threaded and also have finger-adjustable flanges; and securing the plunger sub-assembly to the toilet body using the underside nut, such that the entire system is installable and operable using fingers-only and no extra tools are needed.

* * * * *